US005136739A

United States Patent [19]

Ide

[11] Patent Number: 5,136,739

[45] Date of Patent: Aug. 11, 1992

[54] WATER BED WITH BUILT-IN DRAIN PUMP

[76] Inventor: Russell D. Ide, 122 Ridge Drive, Exeter, R.I. 02822

[21] Appl. No.: 818,264

[22] Filed: Jan. 8, 1992

[51] Int. Cl.[5] ..... A47C 27/08

[52] U.S. Cl. ..... 5/451; 5/453; 5/918; 417/151; 417/181; 141/65

[58] Field of Search ..... 5/451, 450, 452, 455, 5/453; 141/65; 417/151, 181

[56] References Cited

U.S. PATENT DOCUMENTS

| | | | |
|---|---|---|---|
| 92,313 | 7/1869 | Hughes | 417/198 |
| 857,920 | 6/1907 | Boekel | 417/198 |
| 995,969 | 6/1911 | Junk | 417/198 |
| 1,040,641 | 10/1912 | Coyle | 417/198 |
| 3,456,270 | 7/1969 | Weinstein et al. | 5/451 |
| 3,748,669 | 7/1973 | Warner | 5/450 |
| 3,766,579 | 10/1973 | Shields | 5/451 |
| 3,879,776 | 4/1975 | Solen | 5/451 |
| 3,999,235 | 12/1976 | Mollura | 5/451 |
| 4,109,333 | 8/1978 | Zmiarovich | 5/451 |
| 4,114,215 | 9/1978 | Santo | 5/451 |
| 4,328,599 | 5/1982 | Mollura | 5/451 |
| 4,332,044 | 6/1982 | Houk, Jr. | 5/451 |
| 4,370,769 | 2/1983 | Herzig et al. | 5/452 |
| 4,389,742 | 6/1983 | DeWitt | 5/455 |
| 4,727,607 | 3/1988 | Nystad | 5/450 |
| 4,810,170 | 3/1989 | Ide | 417/198 |

*Primary Examiner*—Alexander Grosz
*Attorney, Agent, or Firm*—Marks & Murase

[57] ABSTRACT

A water bed having a built-in drain pipe. The water bed includes a water tight bladder which has an inlet port and an outlet port formed therein. A jet pump is connected between the inlet port and the outlet port and located in the interior of the water tight bladder such that the contents of the water tight bladder can be sucked out by providing a motive liquid at the inlet port and attaching drain tubing at the outlet port. The jet pump includes a jet nozzle, a diffuser and a spacer for aligning the jet nozzle and the diffuser. A chamber can be provided around the jet nozzle and diffuser to allow filtering of fluid drawn into the diffuser. The pump can be formed as a one-piece venturi pump element.

20 Claims, 4 Drawing Sheets

WATER BED WITH BUILT-IN DRAIN PUMP

BACKGROUND OF THE INVENTION

A water bed is simply a water filled bladder that is used as a mattress. The bladder is sometimes filled with fiber or fitted with internal channels to improve comfort. Otherwise, the interior of the mattress can be empty. Examples of known water bed assemblies are shown in U.S. Pat. No. 3,748,669 to Warner and U.S. Pat. No. 3,999,235 to Mollura.

Typically, the water-tight bladder is fitted with one or more valves through which water is added to fill the bladder or pumped out to drain the bladder. The conventional valve is simply a threaded neck of the type shown in the Warner patent which may be capped.

FIG. 1 shows a conventional water bed mattress. The water bed mattress includes a water tight bladder 5 having a water tight interior area 50 which may be filled with water so that the bladder may be used as a mattress. As mentioned above, the bladder 5 is sometimes filled with fiber or fitted with internal channels to improve comfort, but for simplicity these are not shown. The water tight bladder may be formed of any suitable water tight material as is known in the art.

The bladder 5 includes a valve through which water can be added to or pumped from the bladder. As shown in FIG. 1, the valve is typically a neck portion formed with threads 3 or the like. The neck-type fill/drain valve 1 is typically formed separately from the water tight bladder 5 and secured thereto by heat or adhesive. The threads 3 need not be formed directly on the neck; they may be provided by attaching an adaptor or the like to the neck as is known in the prior art.

In FIG. 1 the overall size of the water filled bladder 5 is represented schematically. As is known in the art, the water filled bladder is typically mattress-sized.

In a conventional water bed, an adaptor may be threaded to the valve threads so that a garden-type hose can be attached for filling or draining. When the bladder is being drained, a pump must be used. Typically, either a venturi pump of the type disclosed in the present inventor's previous patent U.S. Pat. No. 4,810,170 or an electric pump is used. In the case of modern fiber filled mattress bladders, an electric pump can be clogged by the fiber fill. Accordingly, in at least these cases, a venturi pump is preferred.

The use of venturi action for causing suction by the passage of fluid through nozzles is well known and documented. A venturi pump typically includes a water supply pipe, and an outlet pipe which is in line with the inlet pipe. Variations of this basic construction are disclosed in the present inventor's previous patent as well as in U.S. Pat. No. 857,920 to Boekel and U.S. Pat. No. 995,969 to Junk.

While venturi pumps offer advantages as a water bed draining pump, known venturi pump constructions are difficult to use with a water bed. Among other things, known venturi pumps are difficult to connect to water beds and must be stored when not in use. These inconveniences have adversely affected the acceptance of venturi pumps for use as water bed drain pumps. Currently the water bed industry is striving to make water beds more user friendly. Accordingly, a premium is placed on user convenience. For these reasons, a water bed with an easy to use venturi pump would be desirable.

SUMMARY OF THE INVENTION

The present invention relates to water bed with a built-in drain pump. The pump of the present invention is preferably a venturi pump that works on the principle that different flow velocities produce different amounts of suction. The bed is fitted with two distinct connections instead of the current one. The second connection remains capped during filling. For draining, however, hoses are attached to both connections. One hose provides a supply of pressurized fluid to the venturi and the second connection allows fluids to discharge.

The bed includes a water-tight bladder having a water tight interior. An inlet port or valve is provided to allow fluid to flow into the interior of the water tight bladder. An outlet port or valve is provided to allow fluid to flow out of the port or valve. A fluid inlet pipe extends into the interior of the water tight bladder from the inlet port. A fluid outlet pipe extends into the interior of the water tight bladder from the outlet port. The distal ends of the inlet and outlet pipes are preferably coaxially aligned. A nozzle is provided in the end of the inlet pipe and a diffuser is formed in the end of the outlet pipe. The nozzle and diffuser are maintained in alignment by a spacer member provided in the interior of the water tight bladder. The spacer member may be of any convenient form, but is preferably formed with openings or elongated slots such that spacer member acts as a filter to prevent clogging of the fluid passages. A filter mesh may be provided to enhance this effect. The venturi pump may be formed as a one-piece element adapted to be inserted into either the outlet pipe or, preferably, the inlet pipe.

DETAILED DESCRIPTION OF THE DRAWINGS

Figure 2:
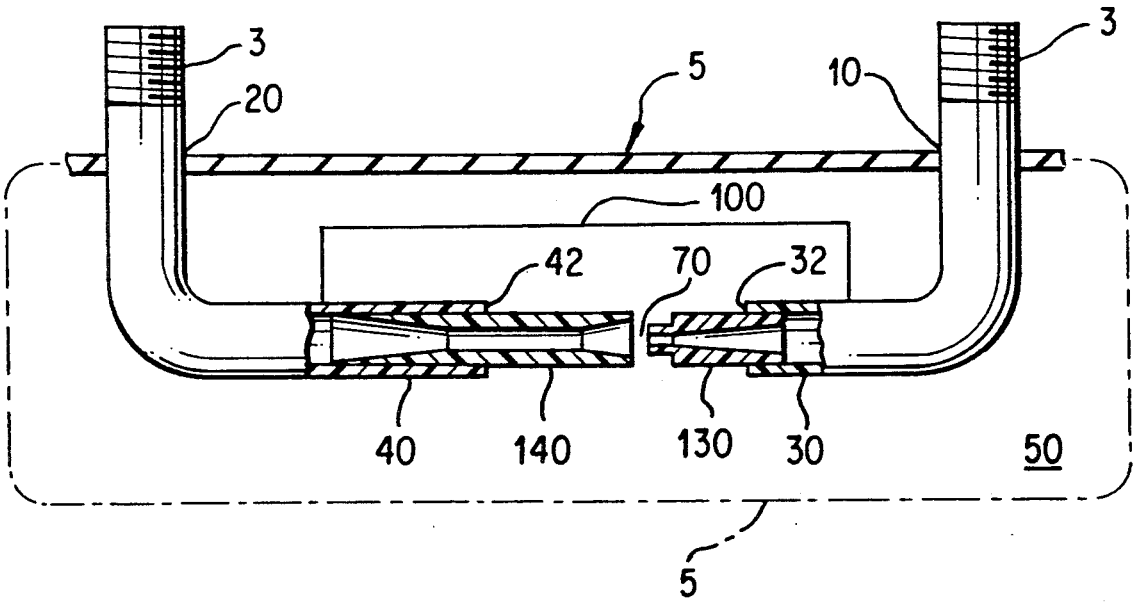
FIG. 2 is a partially schematic view of a water bed mattress according to the present invention showing a detailed view, partially in section, of a built-in drain pump according to the present invention.

FIG. 2 shows, somewhat schematically, the water bed construction of the present invention. The water bed mattress includes a water tight bladder 5 having a water tight interior 50. The body of the water tight bladder is, again, schematically depicted and would actually be much larger in relation to the other components.

Figure 1:
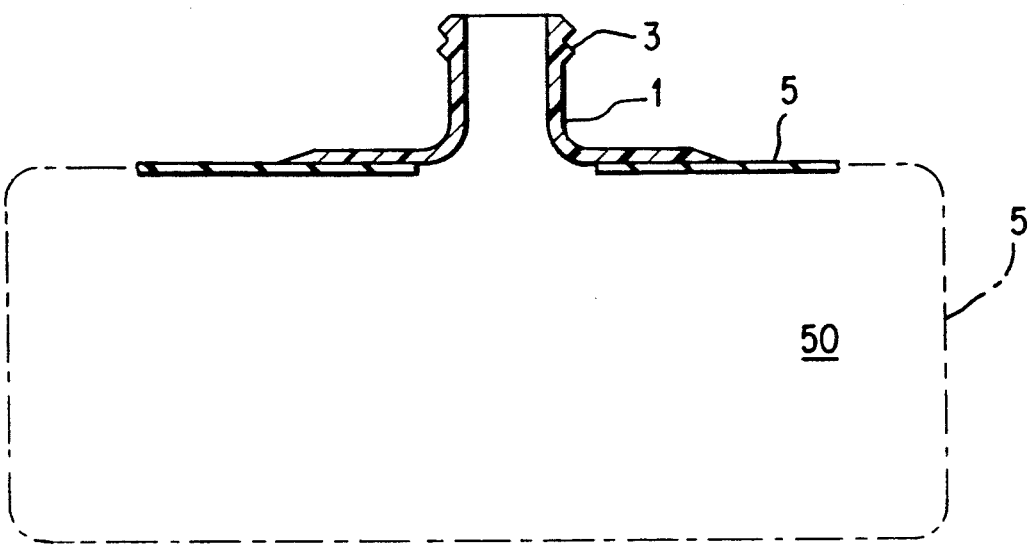
FIG. 1 is a schematic representation of a prior art water bed mattress showing the details, in section, of the valve for filling and draining the mattress.

Unlike the conventional mattress shown in FIG. 1 the mattress of the present invention includes two openings into the water tight bladder—an inlet port 10 and an outlet port 20. A connection or valve is formed at each port. The valves may have a thread 3 formed at their ends so that a cap (not shown) can be secured to the valve to prevent flow through the valve. The threads also allow attachment of a garden hose (not shown) either directly or through an adaptor to allow filling and draining as described below. A typical adaptor is illustrated at 13 in FIGS. 5 and 7.

As shown in FIG. 2 an inlet pipe 30 extends from the inlet port 10 into the interior 50 of the water tight bladder 5. Similarly, an outlet pipe 40 extends from the outlet port 20 into the interior 50 of the water tight bladder 5. The inlet pipe 30 and the outlet pipe 40 each have a distal end, 32, 42, respectively, which is the end of the pipe 30, 40 spaced from the port 10, 20. The distal ends 32, 42 of the pipes 30, 40 are coaxially aligned as shown in FIG. 2. The ends 32, 42 of the pipes 30, 40 are maintained in alignment by a spacer 100. The spacer 100 may have various constructions some of which are below. Regardless of the specific construction used, the spacer mechanism must, at a minimum, maintain the alignment and spacing of the ends 32, 42 of the pipes 30, 40.

A jet nozzle 130 is fitted into the inlet pipe 30 and a diffuser 140 is fitted into the outlet pipe 40. The jet nozzle 130 shown is in the form of a tubular member with a central bore that decreases in internal diameter from the point where the fluid enters; this construction leads to increased velocity and decreased pressure of the fluid in a known manner.

The inner opening of the diffuser tube, 140 is in line with the outlet of the jet 130 with a space 70 between them as illustrated. Because of the decreased pressure of the fluid exiting the nozzle 130, a low pressure, high suction vacuum region is created at the space 70. The diffuser is formed with a passageway which is outwardly flared at both ends and at the outer end thereof is located within the outlet pipe 40 so that fluid passing through the outlet end can be carried away to a suitable outlet source.

Because a vacuum is present in the region 70 between the end of the jet and the beginning of the diffuser 140 water is drawn from the interior 50 of the bladder through the diffuser 140 and out of the water tight bladder 5 via the outlet port 20. The amount of fluid passing through the diffuser is significantly greater than the amount of fluid exiting the jet nozzle such that the interior of the bladder is drained. The diffuser 140 converts the velocity head of the fluid exiting the jet nozzle into a pumping head to pump the fluid out of the bladder. The pump as described above operates in accordance with known venturi principles.

If desired, a ball valve or other mechanism for increasing turbulence so as to increase the suction force as described in the present inventor's previous U.S. Pat. No. 4,810,170 could be employed. This is not, however, believed necessary.

As noted above, the spacer mechanism 100 must space the jet nozzle 130 from the diffuser 140 to obtain optimum suction at the vacuum region 70. There are various possible constructions for the spacer mechanisms. The simplest construction is a metal bar schematically indicated in FIG. 2 which rigidly holds the inlet 30 and outlet 40 pipes in place.

Figure 3:
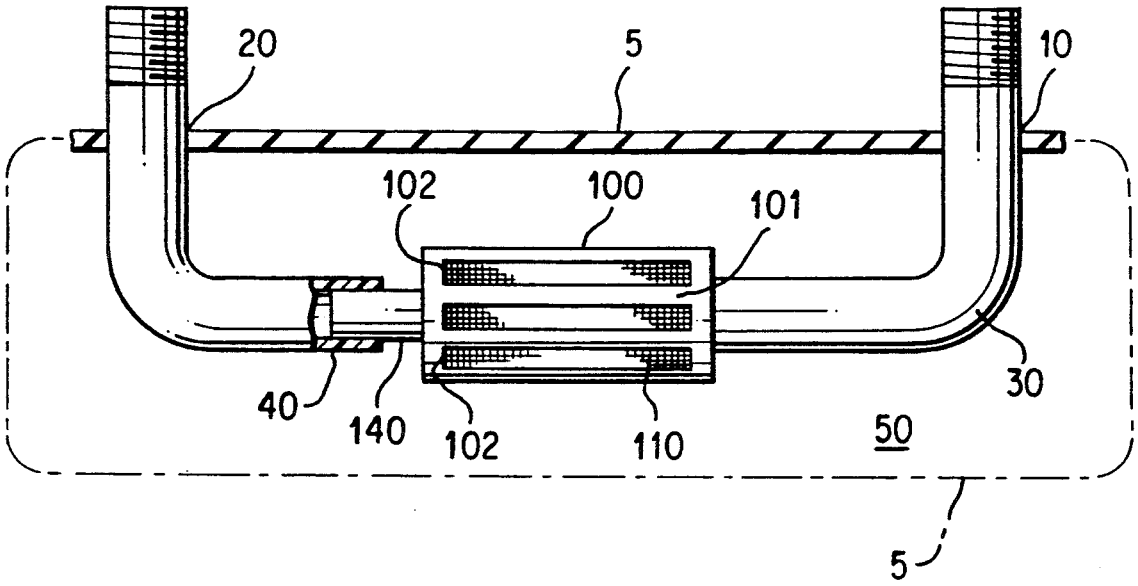
FIG. 3 is a partially schematic view of the water bed mattress of the present invention showing the details of one embodiment of a spacer mechanism according to the present invention.

FIG. 3 shows a water bed construction similar to that of FIG. 2 except that the details of the construction of one embodiment of a spacer mechanism 100 according to the present invention are illustrated. In this case, the spacer mechanism is a chamber-like body 100 having a series of elongated openings 102 formed in the wall to allow fluid to be sucked into the chamber of the spacer 100. The elongated slots 102 are separated by elongated wall portions 101. When the jet pump is operating, fluid is sucked from the interior 50 of the water tight bladder 5 through the openings 102 and into the outlet pipe 40 and subsequently through outlet port 20 out of the water tight bladder 5. If desired, the spacer 100 may include a filter for filtering any particulate matter such as the fiber or filler in the mattress. To some extent the elongated wall members 101 form a grill which serves to filter very large pieces. If it is necessary to filter smaller pieces, a filter mesh or other type filter such as that illustrated at 110 may be provided over the elongated openings 102 for such a purpose.

Figure 4:
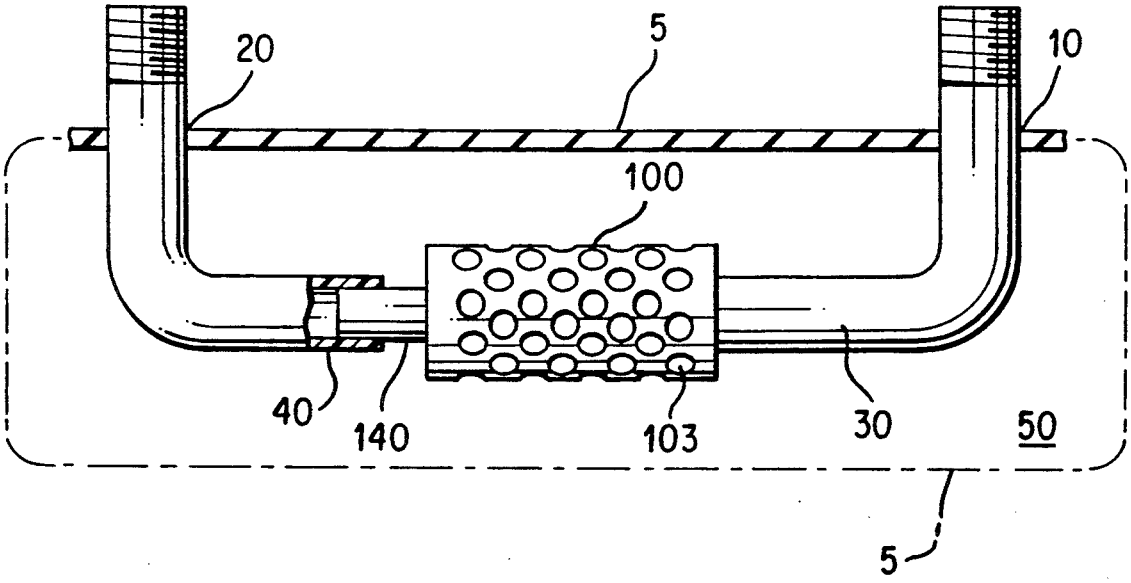
FIG. 4 is a partially schematic view of the water bed mattress of the present invention showing the details of another spacer mechanism according to the present invention.

FIG. 4 shows a water bed construction similar to that of FIG. 3 with a different spacer member 100. In this case, the spacer member 100 is formed as a chamber, but includes a spaced series of openings 103 which allow water to be sucked from the interior 50 of the water tight bladder 5 into the chamber 100 of the spacer and subsequently through the outlet pipe 40 and outlet port 20 to the exterior of the water tight bladder 5. The spaced series of openings act as a filter for large pieces of material. Again, if desired, a smaller filter mesh may be used to filter smaller pieces.

The venturi pump can be formed as a single one-piece member adapted to be inserted into either the outlet port or, preferably, the inlet port. Such a construction offers several advantages. One advantage is that the pump assembly can be easily removed from the interior of the mattress. Another advantage is that the number of parts is decreased. This simplifies assembly and can reduce manufacturing costs.

FIGS. 5, 6A, 6B and 7 illustrate an embodiment using a one-piece pump. In the illustrated embodiment, the one-piece pump 200 is adapted to be located in the inlet port 10 rather than the outlet port 20. Alternatively, the one-piece pump 200 can be designed for insertion into the outlet end by simply flipping the position of the diffuser and the jet nozzle portions.

Figure 5:
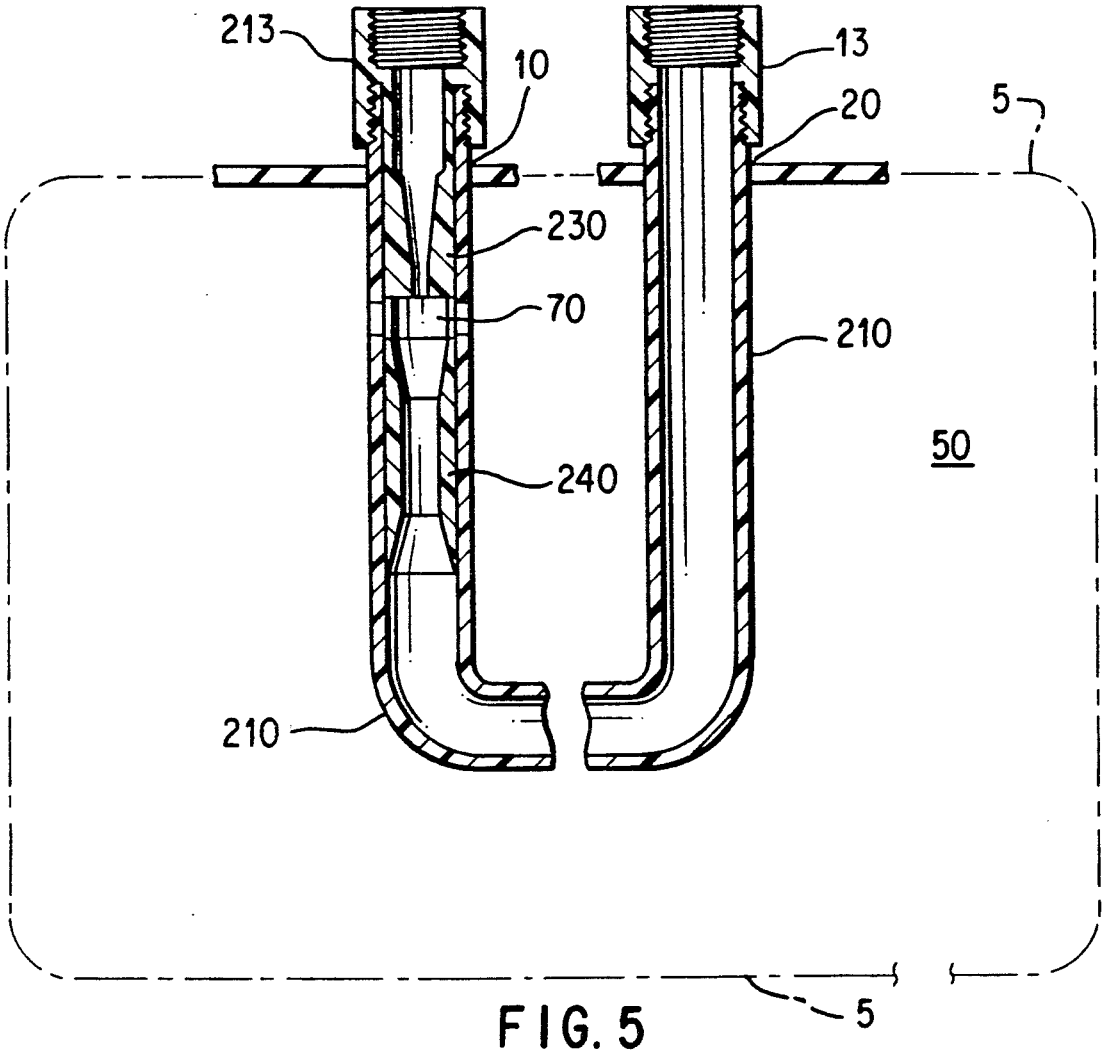
FIG. 5 is a partially schematic cross-sectional view of the water bed of the present invention with a different form of venturi pump.

As shown in FIG. 5, the water bed of this embodiment includes a water-tight mattress 5 having a water-tight interior 50. Again, the mattress includes two openings into the water-tight bladder—an inlet port 10 and an outlet port 20. A connection or valve is formed at each port and each connection is formed with threads 203. At the outlet end, an adaptor 13 is screwed on to the threads 203. The adaptor 13 is a conventional adaptor which allows a conventional garden hose to be threaded into the adaptor 13 such that the garden hose can be coupled to the outlet connection.

A fluid pipe 210 extends between the outlet port and the inlet port. The fluid pipe 210 can be of conventional construction except that it should, preferably, extend straight from the port into which the one-piece venturi pump will be inserted for reasons which will become obvious below. The pipe 210 should also include openings 206 which are positioned so as to align with the openings 205 in the venturi pump described below.

Figure 6A:
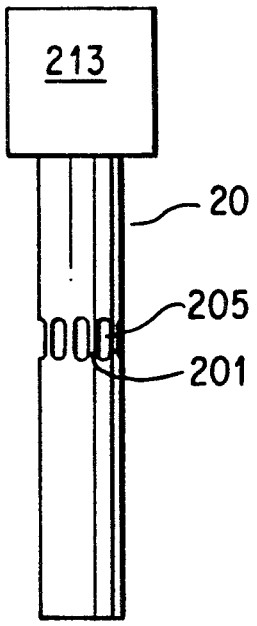
FIG. 6A is a side view of the one-piece venturi pump insert used in the embodiment of FIG. 5.
Figure 7:
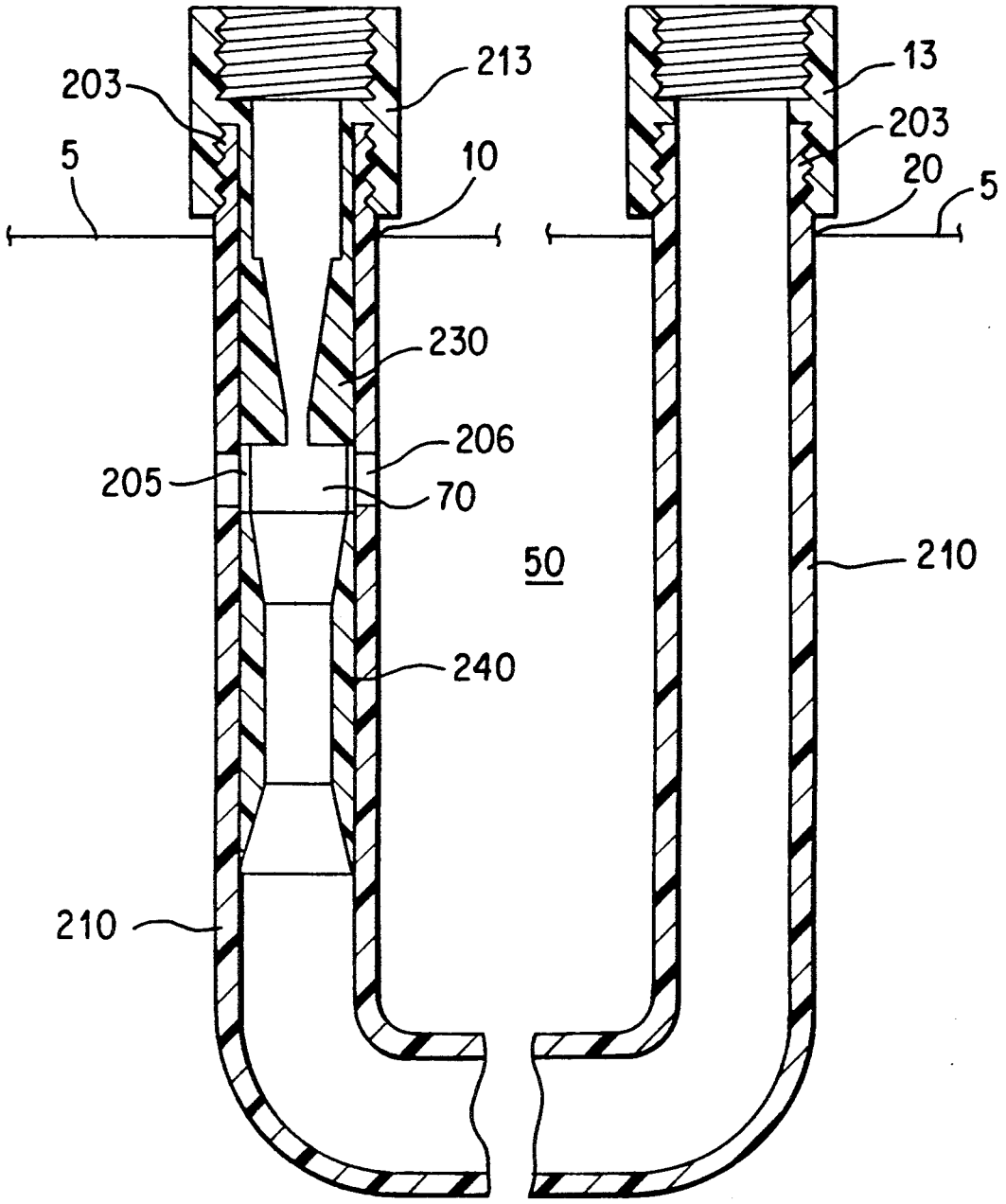
FIG. 7 is a cross-sectional detail view of the portion of the embodiment of FIG. 5 which includes the pump.

The venturi pump 200 includes an adaptor head 213 which is adapted to be screwed on to the threads 203 formed on the inlet connection. As best shown in FIG. 7, the adaptor head 213 includes an additional set of internal threads to allow a garden hose or similar tubing to be threaded into the adaptor head 213. As best shown in FIGS. 5 and 7, the venturi pump 200 includes a pump portion which is adapted to be inserted into the straight portion of the fluid pipe 210. The pump portion includes a jet nozzle portion 230, a diffuser portion 240 and, as best shown in FIG. 6A, thin spacer ligaments 201 for connecting the jet nozzle portion 230 to the diffuser portion 240 so as to maintain alignment of these two portions. The ligaments 201 are separated from one another by a series of spaced openings 205 which act as suction openings in the manner described above.

The operation of the one-piece venturi pump 200 is the same as the previously described venturi pump. The jet nozzle portion 230 functions in the same manner as the jet nozzle 130 of FIG. 2. Likewise, the diffuser portion 240 functions in the same manner as the diffuser 140 of FIG. 2. The ligaments 201 perform the function of the spacer member 100 of FIG. 2. The fluid tube 210 acts as both an inlet pipe and an outlet pipe. Thus, when fluid is caused to flow into the inlet port, a low pressure, high suction vacuum region is created at the space 70. As a result, fluid is drawn from the interior 50 of the mattress out of the outlet port.

Figure 6B:
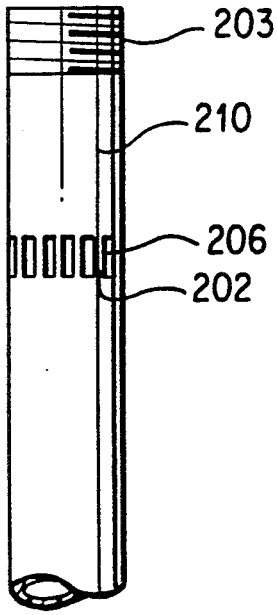
FIG. 6B is a side view of a portion of the fluid pipe used in the embodiment of FIG. 5.

As best shown in FIG. 6A and 6B, the openings 205 formed in a side wall of the pump member 200 are positioned so as to be aligned with the openings 206 formed in the fluid pipe 210 when the pump 200 is fully inserted into the pipe 210. When the openings 205, 206 are aligned they act in the same manner as the elongated slots 102 in the embodiment of FIG. 3. In particular, they allow fluid to be sucked from the interior 50 of the water-tight bladder 5 into the diffuser portion 240.

As discussed above with the embodiments of FIGS. 3 and 4, the openings 205, 206 provide some degree of filtering. If desired, a filter mesh or other type filter may be provided over the openings to enhance filtering.

It can be seen from the foregoing description that the water bed of the present invention includes a built-in venturi type drain pump. The bed is fitted with two distinct cap-type valves instead of the conventional one. In operation, the second valve or outlet port is capped to allow filling. For draining, hoses are attached to both connections and the inlet hose provides a supply of motive fluid to the venturi and the second hose discharges fluids.

What is claimed is:

1. A water bed having a built-in drain pump, the water bed comprising:

a water tight bladder having a sealed interior;

an inlet port formed in the water tight bladder to allow fluid to pass into the interior of the water tight bladder;

an outlet port formed in the water tight bladder to allow fluid to flow out of the water tight bladder;

an inlet pipe extending from the inlet port into the interior of the water-tight bladder;

an outlet pipe extending from the outlet port into the interior of the water tight bladder;

each of the inlet pipe and the outlet pipe having a distal end, the distal end being spaced from the respective port and the distal ends of the inlet pipe and the outlet pipe being coaxially aligned;

a jet nozzle fitted in the inlet pipe, the jet nozzle having an inlet opening and a discharge opening, the inlet opening being larger than the discharge opening such that the velocity of fluid passing through the nozzle is increased; and a diffuser fitted in the outlet pipe, the diffuser having an inlet opening and an outlet opening, the inlet opening of the diffuser being larger than the outlet opening of the jet nozzle;

the discharge end of the jet nozzle being coaxially aligned with the inlet end of the diffuser and spaced therefrom; and a spacer member for maintaining the alignment and spacing of the jet nozzle and the diffuser, the spacer member being connected to the jet nozzle and the diffuser whereby when fluid is caused to flow through the jet nozzle, a suction pressure is created.

2. The water bed of claim 1, wherein both the inlet port and outlet port have threaded couplings for attachment to fluid conducting tubing.

3. The water bed of claim 1, wherein the spacer includes a filter for filtering fluid drawn into the diffuser.

4. The water bed of claim 1, wherein the spacer is formed as a chamber having at least one wall formed with a plurality of openings.

5. The water bed of claim 1, wherein the jet nozzle, spacer member and diffuser are formed as a one-piece venturi pump element.

6. The water bed of claim 5, wherein the inlet pipe and the outlet pipe are formed as a single pipe adapted to receive the venturi pump element.

7. A water bed with a built-in drain pump, the water bed comprising: a water tight bladder having a water tight interior; an inlet port formed in the water tight bladder; an outlet port formed in the water tight bladder; and a jet pump connected between the inlet port and the outlet port whereby when a motive fluid is passed into the inlet end of the inlet port, the motive fluid and the fluid in the water tight bladder are caused to flow out of the outlet end of the bladder, the jet pump comprising: a housing assembly defining a chamber having at least one wall formed with a plurality of suction openings through which fluid may pass; a tubular inlet pipe for supplying motive liquid to the pump; a tubular outlet pipe in axial alignment with the tubular inlet pipe; a jet nozzle, the jet nozzle having an inlet end fitted in the inlet pipe and a discharge end, the discharge end being located within the chamber; a diffuser, the diffuser having an inlet end located in the chamber and an outlet end, the outlet end being fitted in the outlet pipe; the jet nozzle and diffuser being aligned and constructed such that fluid exiting through the jet nozzle creates a suction at the entrance to the diffuser whereby fluid is drained from the interior of the water tight bladder.

8. The water bed of claim 7, wherein filter means are provided in the suction openings formed in the chamber walls for filtering fluid passing through the openings.

9. The water bed of claim 7, wherein the inlet port has a threaded coupling for attachment to a supply of motive liquid.

10. The water bed of claim 7, wherein the outlet port has a threaded coupling for attachment to a fluid exhaust tube.

11. The water bed of claim 7, wherein the jet nozzle, spacer member and diffuser are formed as a one-piece venturi pump element.

12. The water bed of claim 11, wherein the inlet pipe and the outlet pipe are formed as a single pipe adapted to receive the venturi pump element.

13. A water bed with a built-in drain pump, the water bed comprising: a water tight bladder having a water tight interior, an inlet port and a separate outlet port formed in said bladder to allow fluid to pass into and out of the interior of the water tight bladder and pump means connected between the inlet and the outlet port such that when motive fluid is caused to flow through the inlet port, a suction force is created within the interior of the water tight bladder such that the contents of the water tight bladder are drained through the outlet port.

14. The water bed of claim 13, wherein the pump means comprises: a housing assembly including a jet nozzle having an inlet end and a discharge end, the inlet end being in fluid communication with the inlet port; a diffuser having an inlet end and an outlet end; and a spacer for aligning the discharge end of the jet nozzle and the inlet end of the diffuser such that fluid exiting the nozzle creates a suction at the inlet end of the diffuser.

15. The water bed of claim 14, further comprising filter means for filtering fluid sucked into the diffuser.

16. The water bed of claim 14, wherein the inlet port has a threaded coupling for attachment to a supply of motive liquid.

17. The water bed of claim 14, wherein the outlet port has a threaded coupling for attachment to drain tubing.

18. The water bed of claim 13, wherein the pump means comprises: a pipe extending between the inlet port and the outlet port and a one-piece venturi pump inserted into the pipe.

19. The water bed of claim 18, wherein the one-piece venturi pump comprises a jet nozzle portion, a diffuser portion and a series of ligaments connecting the jet nozzle to the diffuser, the ligaments being separated from one another by a series of openings.

20. The water bed of claim 19, wherein the pipe is provided with a spaced series of openings which overlap the openings provided between the ligaments of the venturi pump.

* * * * *